United States Patent [19]

Vedda et al.

[11] 3,941,183

[45] Mar. 2, 1976

[54] LIQUID COOLED ELECTROMAGNETIC CONTINUOUS CASTING MOLD

[75] Inventors: Louis Vedda, Metz; Alain Leclercq, Gargenville, both of France

[73] Assignee: Institut de Recherches de la Siderurgie Francaise (IRSID), Saint-Germain-en-Laye, France

[22] Filed: Oct. 18, 1974

[21] Appl. No.: 515,925

[30] Foreign Application Priority Data

Oct. 19, 1973 France ..... 73.37514

[52] U.S. Cl. ..... 164/147; 164/251; 164/283 M; 164/348

[51] Int. Cl.[2] ..... B22D 11/04; B22D 27/02

[58] Field of Search ..... 164/146, 147, 49, 251, 164/133, 348, 82, 283 R, 283 M, 273, 89

[56] References Cited

UNITED STATES PATENTS

| | | | |
|---|---|---|---|
| 3,693,697 | 9/1972 | Tzavaras | 164/147 X |
| 3,804,147 | 4/1974 | Babel et al. | 164/147 X |

FOREIGN PATENTS OR APPLICATIONS

| | | | |
|---|---|---|---|
| 32,486 | 8/1922 | Japan | 164/49 |
| 257,707 | 1970 | U.S.S.R. | 164/49 |
| 229,759 | 1969 | U.S.S.R. | 164/82 |

*Primary Examiner*—Francis S. Husar
*Assistant Examiner*—Gus T. Hampilos
*Attorney, Agent, or Firm*—Kurt Kelman

[57] ABSTRACT

A jacketted mold for the continuous casting of molten metal is surrounded by a laterally confined space holding an electromagnetic inductor for moving the molten metal in the open-ended mold. Liquid cooling medium is supplied to the mold jacket through an inlet chamber at one end and is evacuated therefrom through an outlet chamber at the other end. The outlet chamber is in communication with the confined space so that the liquid cooling medium cools not only the mold but also the inductor.

2 Claims, 1 Drawing Figure

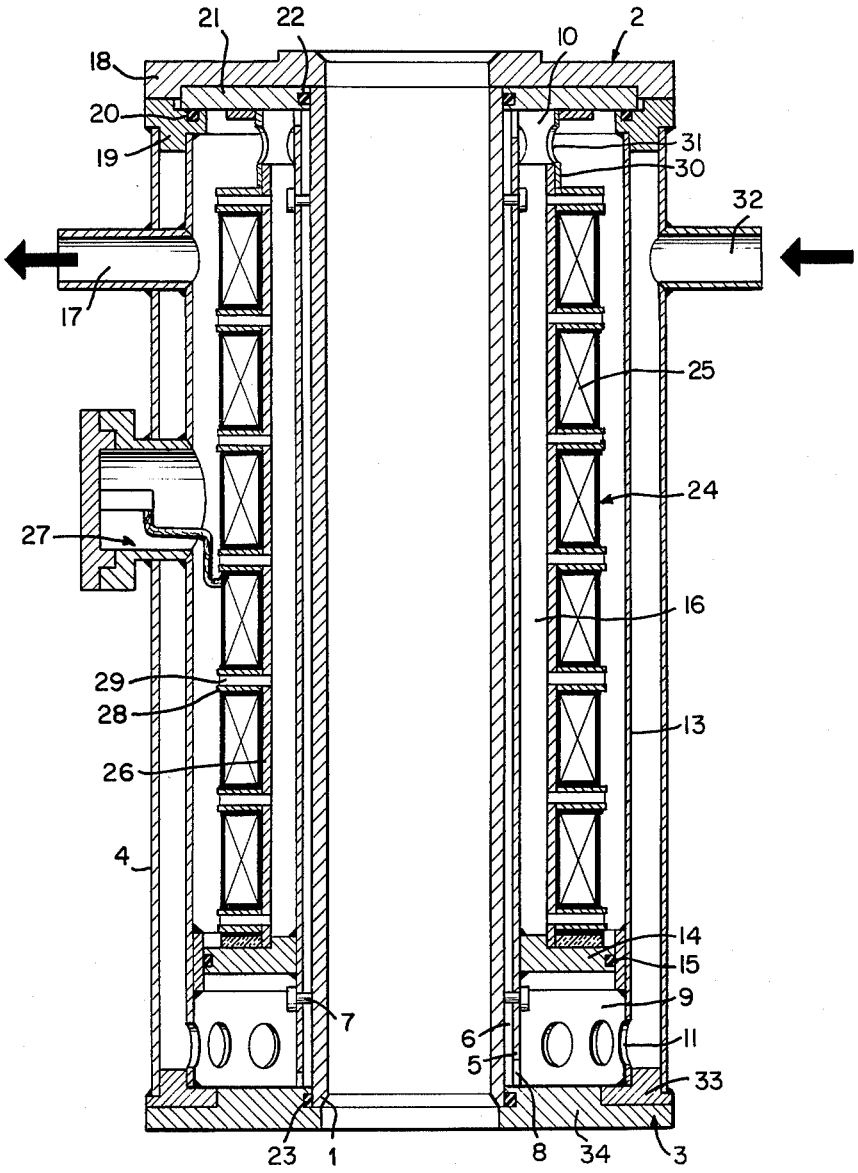
21
22
10
2
18
20
19
31
30
32
17
25
24
27
16
29
28
13
26
4
14
15
9
7
6
11
5
33
23
1
8
34
3

LIQUID COOLED ELECTROMAGNETIC CONTINUOUS CASTING MOLD

The present invention relates to the continuous casting of molten metal, and more particularly to a tubular mold wherein the molten metal is moved electromagnetically and which is cooled by a circulating liquid cooling medium.

It is known to provide molds which comprise a tubular mold element having two open ends and defining a passage for the casting between the open ends, a jacket surrounding the tubular mold element and defining therewith an annular cooling space, an inlet chamber for a liquid cooling medium, generally water, and an outlet chamber for the liquid cooling medium, the cooling space being in communication with the inlet chamber at one end and with the outlet chamber at the other end to permit continuous circulation of the cooling medium through the cooling space. Generally, the liquid cooling medium is delivered through a conduit to the inlet chamber at high speed.

It has also been proposed to mount means adjacent the tubular mold element for moving the molten metal electromagnetically in the mold passage. Such means may be constituted, for example, by an electromagnetic inductor means of the type constituted by the stator of a synchronous motor fed by polyphase current so as to generate a gliding magnetic field. Such means induce within the molten metal in the mold Foucault currents giving rise to electromagnetic forces in the presence of a magnetic field so as to impart to the molten metal a movement in the direction of the sweep of the lines of force of the magnetic field generated by the inductor. This improves the quality of the casting, particularly as far as the skin of the product is concerned.

In known molds of this type, the inductor is usually disposed around the mold. In view of the cooling jacket surrounding the mold, the distance between the inductor and the molten metal in the mold is, therefore, considerable, and this reduces the effectiveness of the device. Also, induced currents may form in constituent parts of the mold, including the cooling jacket. This leads to the utilization of nonmagnetic materials for the mold parts, to the largest extent possible, or to the use of a laminar construction designed to avoid a substantial weakening of the field generated by the inductor. All of this increases the cost of the mold and fails to give full operating satisfaction.

Furthermore, the inductor itself is subject to considerable heating and must be properly cooled to keep it operating satisfactorily and to avoid the eventual destruction of the electric insulation between the conductors.

It is the primary object of this invention to overcome these disadvantages and, more particularly, to reduce the air gap between the molten metal casting and the electromagnetic inductor as much as possible, to limit the use of non-magnetic structural materials to the largest possible extent, and to permit the inductor to be cooled efficiently and at a minimum expense.

The above and other objects are accomplished in accordance with the invention with a mold of the first-described type which comprises a casing surrounding the mold jacket and defining therewith a laterally confined space extending longitudinally along at least a portion of the jacket. A liquid-tight element is arranged at one end of the laterally confined space to separate the confined space from the inlet chamber for the liquid cooling medium and the laterally confined space is in communication with the outlet chamber for the liquid cooling medium. The electromagnetic inductor means for moving the molten metal in the passage of the tubular mold element is mounted in the laterally confined space so as to be cooled by the liquid cooling medium evacuated from the cooling space between the jacket and tubular mold element through the outlet chamber.

According to a preferred embodiment of the present invention, the inductor means is mounted in the confined space at a distance from the jacket and the casing to define respective zones on either side of the inductor means, and the confined space zones are in communication with each other along substantially the entire length of the confined space through a plurality of laterally extending bores in the inductor means.

In a mold constructed according to this invention, the electromagnetic inductor means is disposed in immediate proximity to the wall of the tubular mold element whose inner wall defines the cross section of the casting passing therethrough in a continuous manner, and the inductor is cooled directly by the circulating liquid cooling medium serving to cool the mold. Thus, an efficient structure is obtained without in any way interfering with the cooling medium circulation system.

The above and other objects, advantages and features of the invention will become more apparent from the following detailed description of a now preferred embodiment thereof, taken in conjunction with the single FIGURE of the accompanying drawing showing a mold according to the present invention in a longitudinal cross section.

Referring now to the drawing, the illustrated mold is designed for the continuous casting of molten metal to produce ingots of rectangular cross section. The mold comprises tubular mold element 1 having two open ends and defining a rectangular passage for the casting between the open ends. The mold element is supported at its respective ends by annular plates 2 and 3, liquid-tight gasket 23 being interposed between the inner rim of annular support plate 3 and the adjoining end of tubular mold element 1. Outer mold wall 4 is mounted between the outer rims of annular support plates 2 and 3, liquid-tight rings 19 and 33 being interposed between the support plate rims and the outer mold wall.

The tubular mold element is cooled in a generally conventional manner by the continuous circulation of water along its outer wall. For this purpose, jacket 5 concentrically surrounds tubular mold element 1, having the same general cross section but slightly larger diameter, the coaxial jacket and tubular mold element defining therebetween annular cooling space 6. Jacket 5 is also supported by annular support plates 2 and 3, and centered in respect of the tubular mold element by studs or centering screws 7 extending to the outer wall of the tubular mold element.

A liquid cooling medium, preferably water, is circulated through the annular cooling space by delivering water through inlet conduit 32 into inlet chamber 9 at one end of the mold and evacuating the water from the cooling space through outlet chamber 10 at the other end of the mold, the water being removed through outlet conduit 17. The cooling space is in communication with the inlet and outlet chambers through cutouts or ports 8 in the periphery of jacket 5 at the respective ends thereof. The water inlet conduit leads into annular chamber 12 defined between outer wall 4 and casing 13 surrounding the jacket, the casing defining lateral ports 11 at one end thereof and leading from chamber 12 into chamber 9. Casing 13 defines laterally confined space 16 with jacket 5 and a liquid-tight element is arranged at one end of space 16 to separate the confined space from water inlet chamber 9, this liquid-tight element consisting of ring 14 welded to jacket 5 and having liquid-tight gasket 15 received in an annular peripheral groove and pressing against the inner wall of casing 13.

Confined lateral space 16 extends in the preferred illustrated embodiment longitudinally substantially along the entire length of jacket 5 although it may be more limited in length to extend only along a portion of the jacket. The upper end of confined space 16 is in communication with cooling water outlet chamber 10 and the outlet conduit 17 opens into the confined space near the upper end thereof to evacuate the water, conduit 17 being affixed to casing 13 and outer wall 4, and passing through annular chamber 12.

In the illustrated embodiment, the upper support plate is constituted by an assembly of annular cover 18 having a central opening of the same cross section as the cross section of the axial passage through tubular mold element 1 and annular plate 21. The cover is placed on ring 19 so that the peripheral rim of the cover is supported on the ring, liquid-tight gaskets 19 and 22 in respective annular grooves in ring 19 and annular plate 21 being interposed, respectively, between the inner rim of ring 19 and the outer rim of annular plate 21, and the inner rim of plate 21 and the outer wall of tubular mold element 1, thus providing a water-tight seal for cooling space 6 and confined space 16 at the upper end of the mold. This arrangement will permit a slight longitudinal expansion of tubular mold element 1 during the high-temperature casting operation, thus avoiding deleterious stresses in the mold structure. Since the order of magnitude of these expansions is small, gasket 20 will always assure a tight seal. The lower support plate is formed by annular plate 34 and ring 33, the outer wall and casing of the mold being welded to rings 19 and 33, while the tubular mold element is supported between annular plates 18 and 34, and the jacket is supported between annular plates 21 and 34.

Electromagnetic inductor 24 of tubular construction is arranted in laterally confined space 16. In the illustrated embodiment, this inductor is constituted by a stator of a tubular linear motor comprising, in the illustrated embodiment, six inductor coils 25 arranged in superposed arrangement and mounted on tubular support 26 so that the inductor is at a distance from jacket 5 and casing 13 to define respective zones in the confined space on either side of the inductor. Each coil comprises a plurality of conductive windings would perpendicularly to the axis of the mold and connected to a predetermined phase of a source of polyphase current so that the current passing through the conductive windings of the coils generates a field whose field lines constitute a succession of north and south poles along the axis of the inductor. These poles are displaced parallel to the axis at a speed directly proportional to the frequency of the current fed to the coils, in accordance with the well known principles of linear motors. The coils are connected to the electric current source by means of insulated conductors passing into a connection box 27 mounted in outer wall 4 and casing 13, and opening into confined space 16. In the illustrated embodiment, the six coils are connected two-by-two in series opposition so as to constitute three phases connected in a triangle. The specific structure of the electromagnetic inductor forms no part of the present invention, any such electromagnetic inductor means for moving the casting through the mold passage being useful and such means being known per se.

Tubular support 26 for the inductor coils is preferably made of an insulating material of sufficient rigidity to support the coils and resistant to corrosion by water (or any other cooling liquid used). We have found asbestos impregnated with a thermosetting synthetic resin to be a very useful material for this purpose.

Annular support elements 28 extend horizontally from support 26 to maintain the inductor coils in position, support elements 28 defining laterally extending bores 29 opening into bores in support sleeve 26 so that the zones on either side of the inductor are in communication with each other substantially along the entire length of confined space 16. The annular support elements and the support sleeve are of the same material and may be integral with each other. Coils 25 may also be impregnated with the thermosetting resin so that the assembly of sleeve 26, support elements 28 and coils 25 constitutes a rigid tubular block mounted on ring 14 which serves as a centering means for the inductor block. The upper end of this block is centered by brace 30 affixed to annular plate 21. The brace has lateral ports 31 through which the upper end of confined space 16 communicates with outlet chamber 10 to permit circulation of the cooling water.

Although the tubular mold element 1 and jacket 5 are of rectangular transverse cross section, the other mold parts are preferably of cylindrical transverse cross section because of ease of manufacture. Therefore, the distance between the internal wall of the cylindrical inductor and the internal wall of the rectangular tubular mold element varies but the gap between them remains relatively small.

The jacket is made of a non-magnetic material, such as for example non-oxidizable, non-magnetic steel, so as not to interfere with the propagation of the magnetic field. The choice of the material for tubular mold element 1 depends primarily on the thermal properties desired, particularly if the melting point of the cast metal is high. Usually, copper or a copper-silver alloy is used for the mold element. While this somewhat weakens the magnetic field, this is not a serious limitation, particularly when relatively low frequencies are used, as is conventional in this type of electromagnetic inductor.

In one particular example, we have continuously cast steel ingots by introducing the molten steel through the upper open end of tubular mold element 1, operating the inductor and passing water through cooling space 6 and confined space 16, the water being delivered through inlet conduit 32 under a pressure of about 4 kg/cm$^2$. The water passes through ports 11 into inlet chamber 9 whence it is forced through ports 8 into cooling space 6. In view of the narrowness of the cooling space, the water circulates through this space at a high speed usually between about 6 and 10 m/sec so that the mold element is quite rapidly cooled, generally to a temperature below 10°C. Thus, the molten metal passing through the mold element solidifies progressively at its periphery, the metal which remains molten being moved constantly by the induced electromagnetic forces. The inductor is so arranged and operated as to avoid air bubbles to be introduced in the casting or on the surface thereof.

At the outlet of cooling space 6, the cooling water enters outlet chamber 10 and, through ports 31, confined space 16. A part of the cooling water is evacuated through outlet conduit 17 while the remainder of the water circulates around inductor 24 in space 16 so as to cool the inductor, heat exchange being improved by the circulation of the water through horizontal bores 29 in the inductor. It will be noted that the cold water introduced into annular chamber 12 will aid in cooling the water in space 16, which is heated by the inductor, by heat exchange through casing 13.

We claim:

1. In a mold for the continuous casting of molten metal, which comprises a tubular mold element having two open ends and defining a passage for the casting between the open ends, a casing surrounding the tubular mold element and defining therewith an annular enclosed space, and an electromagnetic inductor means arranged in the annular enclosed space for moving the molten metal in the passage, the inductor means and the tubular mold element defining an annular gap therebetween, the improvement of 1. a tubular jacket mounted in the annular gap, the jacket defining
   a. an inner annular space with the tubular mold element, the inner annular space being laterally confined by the mold element and the jacket for cooling the mold element, and
   b. an outer annular space with the inductor means, the outer annular space being laterally confined by the jacket and the inductor means for cooling the inductor means; and
2. an annular liquid-tight element at one end of the annular enclosed space and arranged between the jacket and the casing to separate the enclosed space into an inlet chamber for a liquid cooling medium and an outlet chamber for the liquid cooling medium,
   a. the inductor means being mounted in the outlet chamber; and
   b. the inner annular cooling space being in communication with the inlet chamber at one end of the jacket and with the outlet chamber at the other end thereof.

2. The mold of claim 1, wherein the inductor means defines a plurality of laterally extending bores, the inductor means being mounted at a distance from the casing to define respective zones in the outlet chamber on either side of the inductor means, and the zones being in communication with each other through the bores in the inductor means substantially along the entire length of the outlet chamber.

* * * * *